US008915779B1

(12) United States Patent
Jardino et al.

(10) Patent No.: US 8,915,779 B1
(45) Date of Patent: Dec. 23, 2014

(54) APPARATUS FOR RETRIEVAL OF VAPOR AND FUMES

(76) Inventors: Joseph Jardino, Arcadia, CA (US); James Duarte, La Mirada, CA (US)

( * ) Notice: Subject to any disclaimer, the term of this patent is extended or adjusted under 35 U.S.C. 154(b) by 387 days.

(21) Appl. No.: 13/436,985

(22) Filed: Apr. 1, 2012

Related U.S. Application Data

(60) Provisional application No. 61/516,291, filed on Apr. 1, 2011.

(51) Int. Cl.

| | |
|---|---|
| ***A45D 1/04*** | (2006.01) |
| ***A45D 1/06*** | (2006.01) |
| *A45D 7/02* | (2006.01) |
| *A45D 1/00* | (2006.01) |

(52) U.S. Cl.
CPC ..... *A45D 1/06* (2013.01); *A45D 2001/002* (2013.01)
USPC ..... 454/367; 34/98; 132/211; 219/201

(58) Field of Classification Search
CPC ..... A45D 2/00; A45D 7/00; A45D 7/06; A45D 44/02; A45D 2011/002
USPC ..... 454/49, 66; 219/225, 226
See application file for complete search history.

(56) References Cited

U.S. PATENT DOCUMENTS

| | | | | |
|---|---|---|---|---|
| 3,295,200 | A | 1/1967 | Padgett | |
| 4,216,581 | A | 8/1980 | Van Slooten | |
| 4,570,651 | A | 2/1986 | Adams | |
| 5,142,786 | A | 9/1992 | Hunts | |
| D348,543 | S | 7/1994 | Melton | |
| 5,377,411 | A | 1/1995 | Andriotis | |
| 5,884,544 | A * | 3/1999 | Theising et al. | 83/100 |
| 6,884,159 | B1 * | 4/2005 | Ferraud, Jr. | 454/119 |
| 6,941,955 | B2 | 9/2005 | Yao | |
| 7,178,532 | B2 | 2/2007 | Kayser | |
| 7,465,904 | B2 | 12/2008 | Kim | |
| 2003/0052115 | A1 | 3/2003 | Leung | |
| 2004/0000319 | A1 | 1/2004 | Carballada | |
| 2004/0251245 | A1 | 12/2004 | Oh | |
| 2005/0204577 | A1 | 9/2005 | Santhouse | |
| 2005/0224091 | A1 | 10/2005 | Cafaro | |
| 2006/0150996 | A1 | 7/2006 | Lun | |
| 2006/0230619 | A1 * | 10/2006 | Williams et al. | 30/133 |
| 2009/0106998 | A1 | 4/2009 | Brown-Carter | |
| 2010/0089413 | A1 | 4/2010 | Wright | |
| 2011/0036822 | A1 * | 2/2011 | Johnson | 219/201 |

OTHER PUBLICATIONS

U.S. Appl. No. 61/516,291, filed Apr. 1, 2011, first inventor: Jardino.

* cited by examiner

*Primary Examiner* — Kang Hu
*Assistant Examiner* — Dana Tighe
(74) *Attorney, Agent, or Firm* — Law Office of David Hong

(57) ABSTRACT

An apparatus for retrieval of vapors or gases produced during the hair styling process comprises: a vacuum nozzle housing, an attachment bracket, a styling iron, a vacuum and at least one filter.

6 Claims, 4 Drawing Sheets

APPARATUS FOR RETRIEVAL OF VAPOR AND FUMES

This application claims priority to U.S. Provisional Patent Application Ser. No. 61/516,291, filed on Apr. 1, 2011, which is incorporated by reference.

BACKGROUND OF THE INVENTION

1. Field of the Invention

This invention relates to a vapor or gas retrieval apparatus for a hair iron, curling iron or similar device.

2. Description of Related Art

Prior to this invention, there were no devices specifically integrating: a nozzle vacuum housing, a vacuum, at least one filter, a connecting bracket and an activation switch to a hair styling apparatus, namely a hair styling iron.

From the preceding descriptions, it is apparent that the devices currently being used have significant disadvantages. Thus, important aspects of the technology used in the field of invention remain amenable to useful refinement.

SUMMARY OF THE INVENTION

This invention relates to an vacuum attachment for a styling or hair iron (flat iron) for use in both consumer and professional hair care settings (i.e. home or hair salon) to evacuate and to suck up any fumes or vapors produced during the hair styling process (such as hair straightening or defrizzing). This vacuum apparatus and mounting bracket allows for retrofitting on most present styling or hair irons. This invention can also be integrated into a styling or hair iron and can employ one or multiple filters.

The invention suctions and extracts much of the vapors produced as a byproduct from hair treatments and at the source of the process being performed on the hair; however working in a good and properly ventilated location is still recommended.

This invention helps remove the vapors from the immediate vicinity of the customer and the hairdresser and is salon friendly; some of the expendable components of this invention are intended to be easily replaceable.

This invention extracts the vapor through the suction ends of the vacuum nozzle housing then through the tube and redirects the vapors into the vacuum through filters, including proprietary filters. After using the apparatus, it is intended for the air in the salon to be significantly cleaner by means of filtering and redirecting.

The present invention introduces such refinements. In its preferred embodiments, the present invention has several aspects or facets that can be used independently, although they are preferably employed together to optimize their benefits. All of the foregoing operational principles and advantages of the present invention will be more fully appreciated upon consideration of the following detailed description, with reference to the appended drawings.

PARTS LISTING FOR VACUUM NOZZLE APPARATUS

Figure 1:
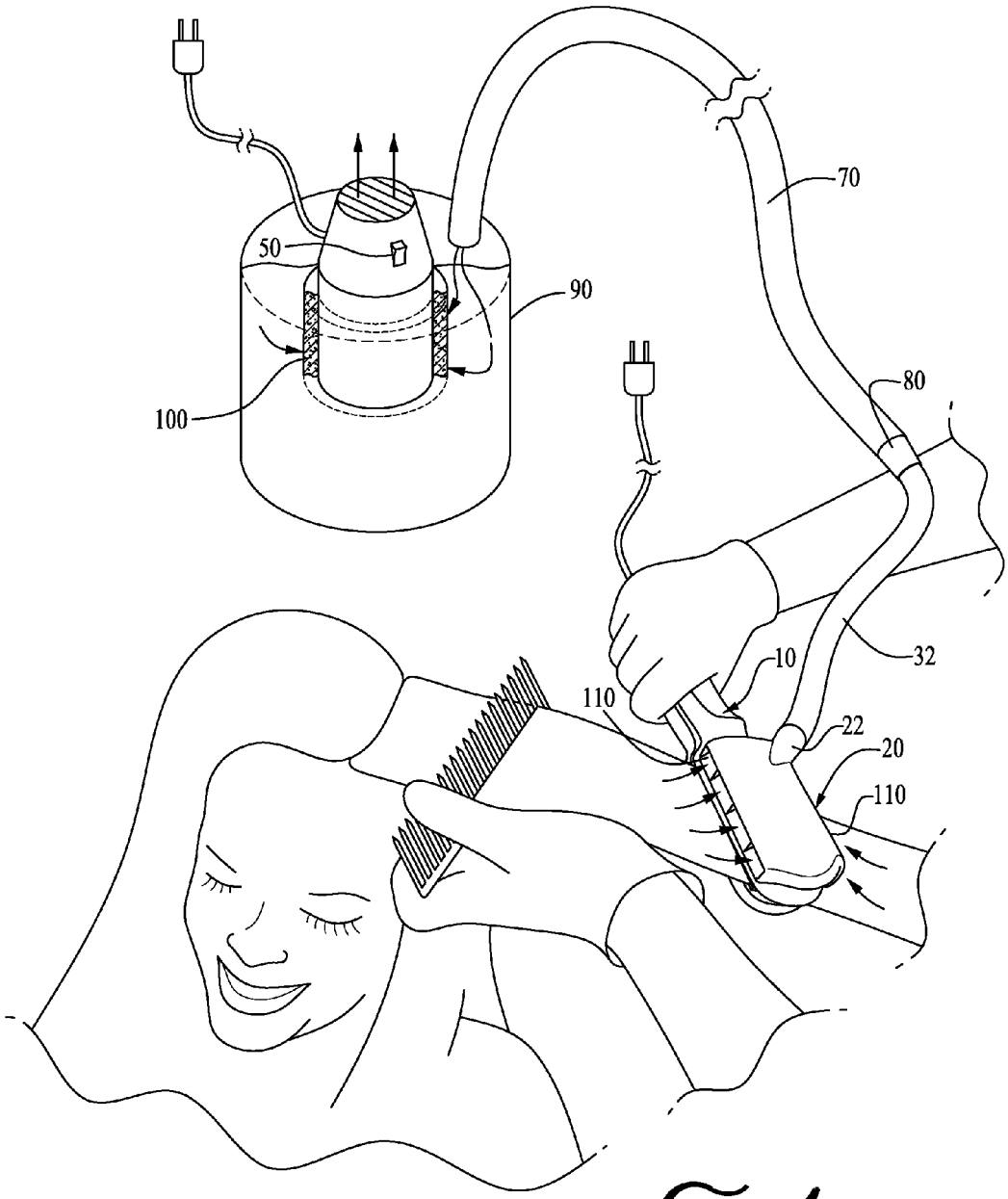
FIG. 1 shows one preferred embodiment of the apparatus for retrieval of vapor and fumes being used on a customer with a styling iron and a vacuum; a comb can also be used to help style the hair of the customer.

10—flat iron or other hair styling apparatus.
20—vacuum nozzle housing; nozzle housing body
22—hose end
24—first suction end
26—second suction end
28—bottom of housing or engagement end (to connect with attachment bracket)
30—slots on engagement end of housing
32—nozzle tube
40—attachment bracket for attaching the nozzle
42—first bracket end (attaches to engagement end/area of vacuum nozzle housing)
44—second bracket end (attaches to styling iron)
46—opening on second bracket end
48—adhesive or connector for second bracket end to styling iron
50—switch (contact or thermal) to turn on the vacuum
60—filter #1 or pre-filter (can be within the housing of the nozzle or outside the edges of the apertures)
70—vacuum hose
80—vacuum hose adapter
90—vacuum
100—filter #2 (can be disposable and replaceable)—within the vacuum unit
110—openings on vacuum nozzle body or housing
120—engagement area on vacuum nozzle housing for bracket; this can be a female engagement area.
130—bracket engagement area to connect to the vacuum nozzle (male piece)

DESCRIPTION OF THE PREFERRED EMBODIMENTS

Referring to the attached FIGS. 1-9, there is illustrated an apparatus for reducing and redirecting vapors or gases produced during the hair styling process or more simply named: a vacuum head or nozzle apparatus. One preferred embodiment of the invention comprises: a vacuum nozzle housing 20, an attachment bracket 40, a styling iron 10 and a vacuum 90. Further, the vacuum nozzle housing can have at least one filter 60 or multiple filters (removable) and a nozzle tube 32.

Figure 2:
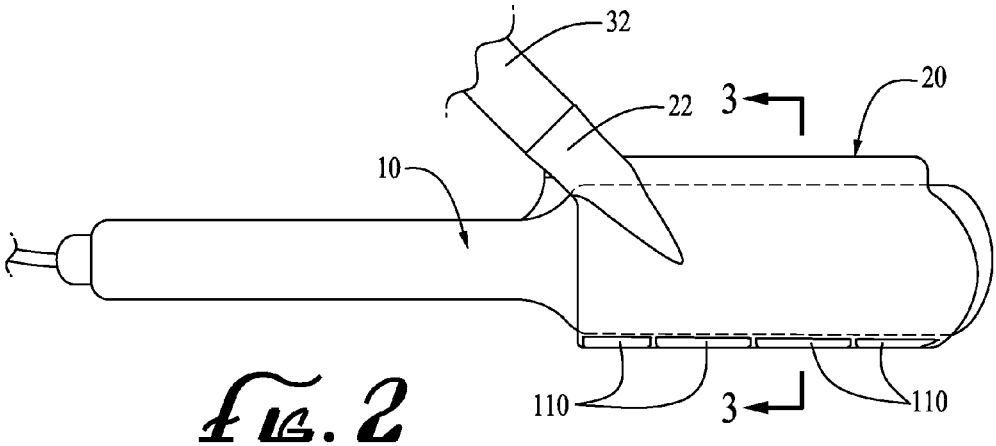
FIG. 2 shows a top view of the apparatus of FIG. 1 and mounted on a hair styling iron.
Figure 7:
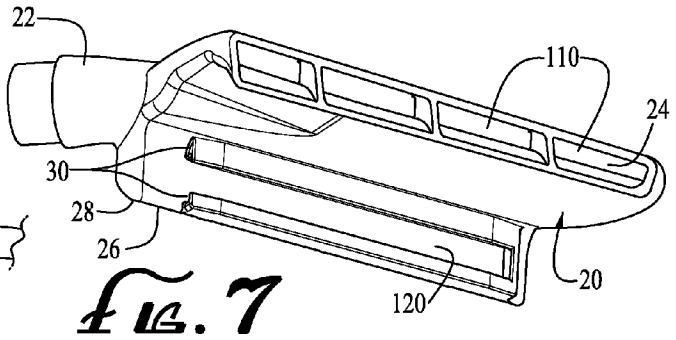
FIG. 7 shows a perspective view of the vacuum nozzle housing and shows the engagement end.

Vacuum Nozzle Housing:

As shown in FIGS. 1, 2 and 7, there is a standard styling or hair iron 10, which is connected to a vacuum nozzle housing 20. The housing can have a generally elongated body, which can mimic the shape of the styling iron.

The vacuum nozzle housing 20 has a first end and a second end; the second end of the nozzle has a opening (hose end 22) to connect to the nozzle tube 32, which connects to the vacuum 90, or directly to the vacuum tube 70 (in embodiments without a separate nozzle tube).

The vacuum nozzle housing 20 also has a first or top surface and a second or bottom surface; the bottom surface 28 has at least one engagement area 120 for connecting to the bracket 40. This engagement area 120 can be a female part to engage to the male part on the connecting bracket 40. As shown in the preferred embodiment in FIG. 7, this engagement area or end 28 has at least one, or as shown, two opposing longitudinal slots 30, grooves, lips or shelves, which define an engagement space 120 for receiving the attachment bracket end.

In other embodiments, this engagement area on the vacuum nozzle housing could employ snap in connections, screws, nuts, bolts, pivoting or rotating or keyed connections or magnets.

As shown in one preferred embodiment (FIG. 7), the bottom surface 28 of the vacuum nozzle housing can generally mimic the outer shape of one side of the styling iron so to couple or cover and to not interfere with the primary purpose of the styling iron (i.e. provide heat to the hair strands placed within the iron sides).

Figure 3:
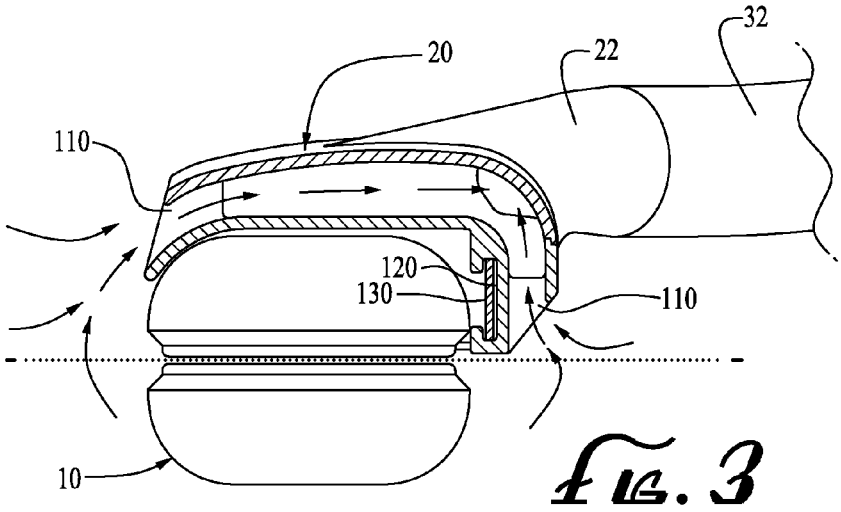
FIG. 3 shows a cross-sectional view of FIG. 1 and along sight lines 3-3.
Figure 6:
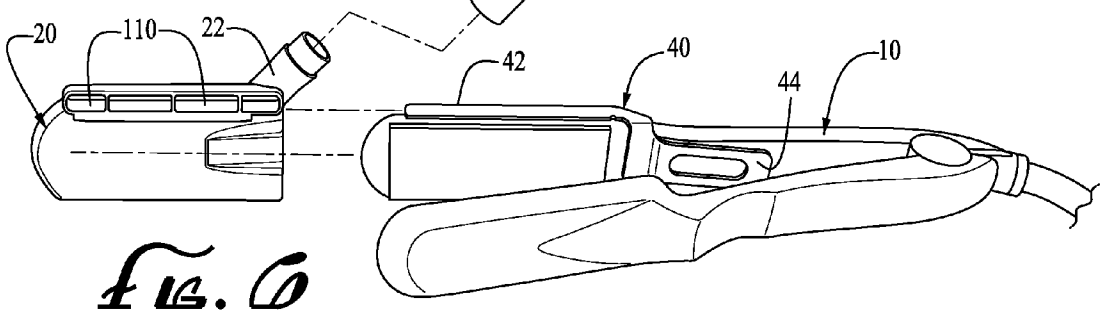
FIG. 6 shows an exploded view of the apparatus with a styling iron, namely the vacuum nozzle housing, attachment bracket, nozzle tube and hose tube.

As shown in FIGS. 3 and 7, in the preferred embodiment, there is are two oppositely facing grooves or slots 30 to engage the first end or blade of the attachment bracket. In FIGS. 1 and 6, the vacuum nozzle housing 20 generally mimics the elongated shape of a standard styling iron 10; also notice how the housing has a central portion and two arms (first and a second) arise from the central portion of the housing and terminate in suction ends or openings.

Figure 8:
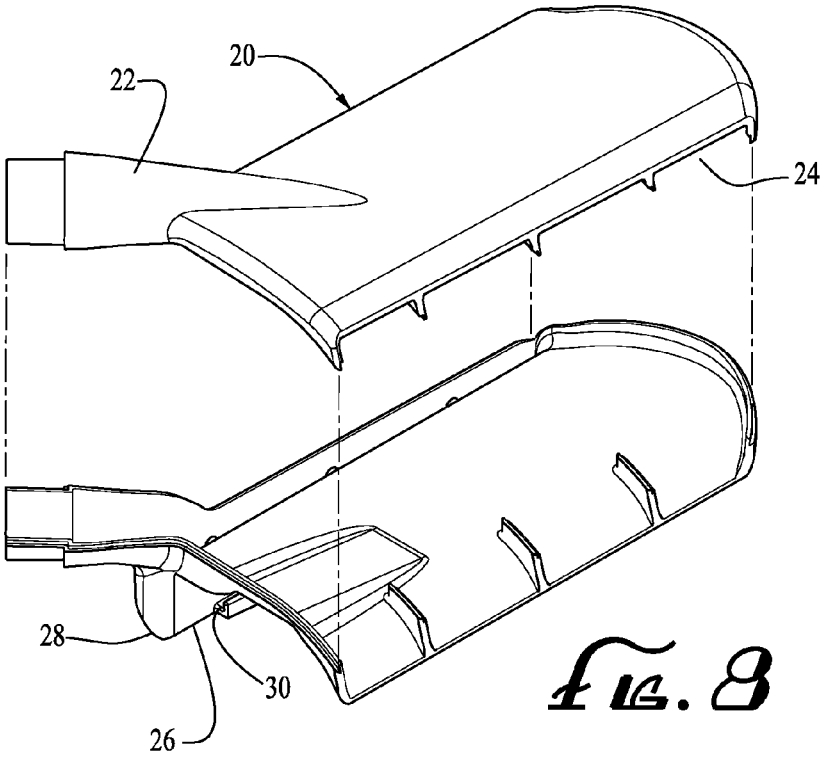
FIG. 8 shows an exploded view of one preferred embodiment of the vacuum head apparatus.
Figure 9:
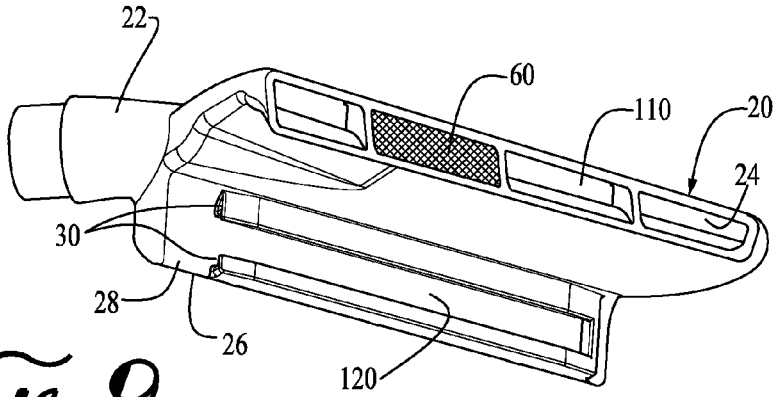
FIG. 9 shows a perspective view of the engagement area of another preferred embodiment of vacuum nozzle housing with a filter located in one of the suction ends.

The vacuum nozzle housing 20 can also have at least one aperture or opening 110 to allow the vacuum to suck up and to remove the vapors and gases produced during the hair styling process. As shown in FIGS. 2 and 6-8, there are multiple vacuum openings 110 or suction ends on the terminal sides of the longer edges of the vacuum nozzle housing. There is first suction end 24 and a second suction end 26 as shown in FIG. 7-9; with this vacuum nozzle housing, there is applied suction from the vacuum and along the length of the styling iron.

Other embodiments allow for placement of other suction openings (on other locations, such as along three quarters or even along the entire length of the vacuum nozzle housing periphery) or possibly a vacuum flow regulator window/adjuster on the vacuum nozzle housing. There may also be adjustable shutters or fins to close or open the vacuum or to adjust where the suction is directed.

A filter 60 or multiple filters can be placed within the vacuum nozzle housing 20, within the suction ends or partially over the vacuum openings. The housing body can be made of any durable and heat resistant material, including alloys, plastic or other recyclable materials.

In FIG. 7, there is one preferred embodiment shown with a vacuum nozzle housing 20, which comprises a hose end 22, a first suction end 24, a second suction end 26 and an engagement end 28. In FIG. 7, the hose end is relatively short, but in other possible embodiments, the hose end can be longer, angled or extend outwardly so that the vacuum tube is guided away from the heated end of the styling iron.

In one preferred embodiment, the housing can be hollow, and there can be a series of ribs or partitions to help guide the suctioned vapors into the vacuum. The housing comprises a hose end, a suction end, and an engagement end, and the hose end is able to be removably connected to the vacuum hose.

In one preferred embodiment, the housing can also comprise a generally hollow or hollow body with a first arm end and a second arm end and a hose end; said first arm end and said second arm end each terminate with a suction end.

As shown in FIG. 8, the housing can have a first or top portion and a second or bottom portion; the bottom portion of the housing can have an indented or concave portion that is inwardly projected so that to facilitate the removable engagement of the first end of the attachment bracket.

In other embodiments, the shape of the housing can be varied and not limited to mirroring the shape of the styling iron head; for example, the vacuum nozzle housing could be shaped like a five armed starfish with each of the arms representing a separate suction end.

Nozzle Tube

The second end of the vacuum nozzle housing 20 has a hose end 22 or nozzle tube opening to connect to a vacuum. In one preferred embodiment, this invention employs a firm or slightly flexible nozzle tube 32 to help keep a flexible or moving vacuum tube out of the way of the user of the styling iron. It is preferred that the nozzle tube 32 be curved away from the portion of the styling iron where the user will hold the iron.

In other possible embodiments, an elongated or angled hose tube end of the vacuum nozzle housing can be used, so that the vacuum tube is guided away from the styling iron and to eliminate the need for a nozzle tube. In other embodiments, the nozzle tube can be flexible or allow for multiple angles or orientation using a flexible joint and conduit type of construction; the user can be able to adjust the position of the nozzle tube and to leave the tube at the desired position without having to hold the tube in place.

Attachment Bracket

The attachment bracket 40 provides a nexus and connection between any commercial hair iron and the vacuum nozzle housing. The bracket has a first attachment end 44 (to the iron body) and a second attachment end 42 (to the vacuum nozzle). By providing this ability to remove the vacuum nozzle housing, the user can continue to employ the styling iron for conventional uses as well as for the vapor vacuum mode.

The attachment bracket allows the use of the vacuum nozzle assembly to be placed on virtually most commercially available styling or hair irons. The attachment bracket has a first end (which can be a male part, which engages the female engagement area on the bottom surface of the vacuum nozzle housing) and a second end, which connects to the inside of one half of the styling iron.

The second end of the bracket can be attached to the styling iron with clips, pivoting clips, bands, glue, double adhesive tape or other good fastening means, including without limitation: screws, magnets or a receptacle integrated in to or onto a styling iron. For example, a manufacturer could integrate a receptacle or slot for the bracket into a styling iron.

The second end of the bracket can also have at least one hole or aperture to allow the styling iron activation button or contact button to reach the other half or side of the styling iron (opposite face). The bracket can be made of any suitable, strong and lightweight material including metal alloy or heat resistant plastics.

In the preferred embodiment as shown in the application figures, the first end of the attachment bracket is blade like and relatively elongated and follows the length of one side of the styling iron. Conceivably any potential shape could be used to engage the vacuum nozzle and different attachment means, including without limitation: clasps, pivoting or rotating clips or pins, friction clips or other removable attachment devices.

In one preferred embodiment, the attachment bracket comprises a first bracket end and a second bracket end; the first bracket end is able to be removably attached to the engagement space or engagement end of the vacuum nozzle housing; the second bracket end is able to be removably attached to the hair styling iron.

Figure 4:
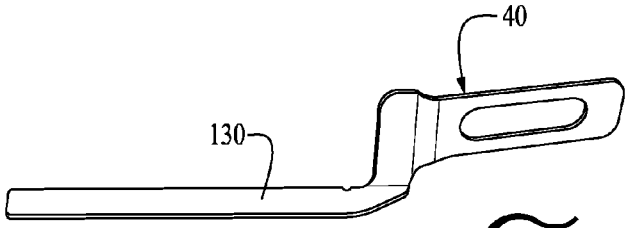
FIG. 4 shows a perspective view of the attachment bracket to mount the apparatus or the vacuum nozzle housing to a hair styling iron.
Figure 5:
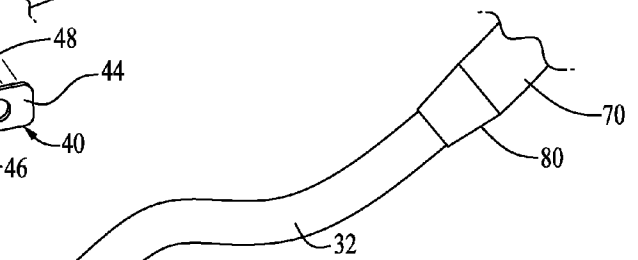
FIG. 5 shows an exploded view of the attachment bracket, an attachment means (adhesive strip or the like) and the hair styling iron or instrument.
Figure 5:
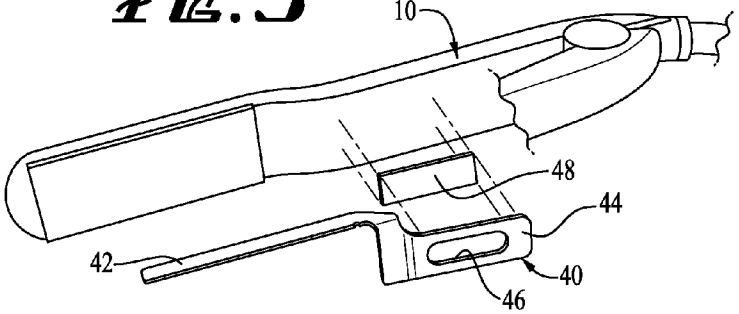

As shown in FIGS. 4 and 5, the first and second bracket ends are generally flat and planar; the second bracket end can also have at least one opening (to allow the contact button or buffer piece on most hair styling irons). The first bracket end lies perpendicularly or generally perpendicularly or at an angle to the second bracket end.

Looking at the second bracket end, this part of the bracket is relatively flat and is oriented parallel to the inside surface of the styling iron; continuing onto the middle portion of the bracket, there is a bridge piece that acts as a transition to another planar piece (first bracket end), which goes from the inside surface of the styling iron to the outer and side surface of the styling iron; this angle is perpendicular, generally perpendicular or curved or angled. The first end of the bracket will follow the length of the styling iron head (typically, the heated pad portion of the styling iron), so that the vacuum nozzle housing can be oriented as close to where the customer's hair is being treated and so that the apparatus can suction and remove as much of the fumes and vapors from the hair styling process.

The first and second bracket ends lie on planes that are at a different angle with respect to one another or are perpendicular or generally perpendicular to one another. The bracket ends are generally flat or planar, but can be other elongated or non-elongated shapes. The first bracket end is engineered to removably connect to the engagement space or area on the vacuum nozzle housing and preferably on the bottom portion of the housing. The first bracket end may also have a small divot or groove on its blade side.

In other embodiments, the first bracket end may also have grooves, holes or engagement areas to associate or communicate with removable engagement devices on the vacuum nozzle housing; for example, if there is a pivoting pin on the vacuum nozzle housing, this pin could engage holes, grooves or divots on the first bracket end. In another example, there could a boss on the surface of the first bracket end, which engages a female portion on the engagement area of the housing. These types of connections can be switched and placed visa-versa.

Styling Iron

As noted above, this invention employs a basic or standard hair styling iron 10; the vacuum nozzle can also be integrated into a dedicated styling iron unit.

Vacuum

Any suitable vacuum 90 can be used with this invention; however, it is preferable to use a vacuum that is both strong enough to evacuate the vapors and fumes from the hair styling process, but at the same time, quiet enough for salon use. Other embodiments of the invention may employ a single attachment vacuum or a portable unit (like a ShopVac brand vacuum); other embodiments may employ large commercial vacuums, which are mounted outside the salon room. Similarly, the vacuum can be placed in an insulating housing or container to muffle or dampen the vacuum sound.

Activation Button for the Vacuum:

After attaching the vacuum nozzle housing to the styling iron via the attachment bracket, the vacuum can then be activated with a separate activation 50 or "ON" button, or alternatively, the activation button is placed so that when the styling iron is moved from the first or open position to the second or closed position, then the vacuum suction will automatically engage.

Other embodiments may allow for the vacuum to be manually operated with a foot pedal, switch, activation button or other similar device on the vacuum or on the styling iron itself (i.e. WIFI or wireless control).

Filter:

As noted above and shown in FIG. 9, a filter 60 can be placed within or around the vacuum nozzle housing; this filter can also have embedded materials or reactants (such as charcoal) to help "soak" up the vapors or fumes or to counter any affects. When attached to a styling iron and a vacuum, the apparatus can help evacuate vapors from the hair styling process and added materials.

In addition, multiple openings on the vacuum nozzle housing help to suck up and evacuate vapors and fumes from the hair styling process. Filters can be used to further evacuate materials in the gases and vapors released during the hair styling process; more than one type of filter can be used at different locations of the vacuum nozzle housing and within the vacuum. Filters 100 can also be placed inside the vacuum unit or at another location in between the apparatus and the vacuum and somewhere along the vacuum tube.

The filters can also have proprietary coatings or materials embedded to further engage any fumes or vapors from the hair styling process. The inventors' intent is to allow the system to maximize the retrieval and redirection of any fumes or vapors from area of the hair styling process (customer and the stylist) and to help clear the air of the salon or work place.

How to Use the Apparatus:

1. Mount the attachment bracket (second bracket end) to the inside of one side of a hair styling iron.
2. Attach the vacuum nozzle housing to the attachment bracket (i.e. attach or slide the vacuum nozzle housing onto the first end of the attachment bracket).
3. Attach the vacuum nozzle housing to the vacuum using a vacuum hose with or without a nozzle tube.
4. Use the styling iron as usual and activate the vacuum to allow the apparatus to suction and vacuum the vapors and fumes generated from the hair styling process.
5. After a certain amount of usage (single or multiple use), the user can replace the vacuum nozzle housing. Filters can also be changed or washed and replaced.

An apparatus for retrieval of vapor and fumes during hair-styling with a hair styling iron, which has a hair styling iron head and a shape, a vacuum and a vacuum hose, comprising:

a vacuum nozzle housing, which comprises a hose end, a first suction end, a second suction end, and an engagement end, the hose end being able to be removably connected to the vacuum hose, the engagement end having two opposing longitudinal slots, which define an engagement space, said vacuum nozzle housing generally mirrors the shape of the hair styling iron head, the first suction end and the second suction end are oriented oppositely on the vacuum nozzle housing;

a bracket, which comprises a first bracket end and a second bracket end, the first bracket end is removably attached to the engagement space on the engagement end of the vacuum nozzle housing, the second bracket end is removably attached to the hair styling iron, the second bracket end has a planar body, the first bracket end lies generally perpendicular to the second bracket end, whereby when the vacuum nozzle housing is attached to the first bracket end and when the hair styling iron is attached to the second bracket end, the vacuum is activated and provides a certain suction such that vapors and fumes are suctioned away from the head of the hair styling iron.

The hose end is removably connected to a vacuum extension arm and said vacuum extension arm is removably connected to the vacuum hose; the second bracket end has at least one opening.

An apparatus for retrieval of vapor and fumes during hairstyling with a hair styling iron, which has a hair styling iron head, a vacuum and a vacuum hose, comprising:

a vacuum nozzle housing, which comprises a hollow body with a first arm end and a second arm end and a hose end;

said first arm end and said second arm end each terminate with a suction end, the hose end is removably connected to the vacuum hose, the vacuum nozzle housing having at least one engagement space, a bracket, which comprises a first bracket end and a second bracket end, the first bracket end removably engages the at least one engagement space of the vacuum nozzle housing, the second bracket end is removably attached to the hair styling iron, whereby when the vacuum nozzle housing is attached to the first bracket end and when the hair styling iron is attached to the second bracket end, the vacuum is activated and provides a certain suction such that vapors and fumes are suctioned away from the head of the hair styling iron.

An apparatus for retrieval of vapor and fumes during hairstyling with a hair styling iron, which has a hair styling iron head, a vacuum and a vacuum hose, comprising: a vacuum nozzle housing, which comprises a hose end, a suction end, and an engagement end, the hose end is removably connected to the vacuum hose, a bracket, which comprises a first bracket end and a second bracket end, the first bracket end and the second bracket end are planar, the first bracket end is removably connected to the engagement end of the vacuum nozzle housing, the second bracket end is able to be removably connected to the hair styling iron, the first bracket end lies angularly to the second bracket end, whereby when the vacuum nozzle housing is attached to the first bracket end and when the hair styling iron is attached to the second bracket end, the vacuum is activated and provides a certain suction such that vapors and fumes are suctioned away from the head of the hair styling iron.

The second bracket end is removably attached to the hair styling iron with an adhesive, pivoting clip, a clasp or a strap; the vacuum nozzle housing has at least one filter; an activation switch for remotely operating the vacuum; the hose end is removably connected to a vacuum extension arm and said vacuum extension arm is removably connected to the vacuum hose; the vacuum nozzle housing has at least one rib; the first bracket end lies generally perpendicular to the second bracket end.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention. Any section headings are not intended to be limiting.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically.

Any element in a claim that does not explicitly state "means for" performing a specific function, or "step for" performing a specific function, is not be interpreted as a "means" or "step" clause as specified in 35 U.S.C. Sec. 112, Paragraph 6. In particular, the use of "step of" in the claims herein is not intended to invoke the provisions of 35 U.S.C. Sec. 112, Paragraph 6.

We claim:

1. An apparatus for retrieval of vapor and fumes during hairstyling with a hair styling iron, which has a hair styling iron head and a shape, a vacuum and a vacuum hose, comprising:

a vacuum nozzle housing, which comprises a hose end, a first suction end, a second suction end, and an engagement end, the hose end being able to be removably connected to the vacuum hose, the engagement end having two opposing longitudinal slots, which define an engagement space, said vacuum nozzle housing generally mirrors the shape of the hair styling iron head, the first suction end and the second suction end are oriented oppositely on the vacuum nozzle housing;

a bracket, which comprises a first bracket end and a second bracket end, the first bracket end is removably attached to the engagement space on the engagement end of the vacuum nozzle housing, the second bracket end is removably attached to the hair styling iron, the second bracket end has a planar body, the first bracket end lies generally perpendicular to the second bracket end, whereby when the vacuum nozzle housing is attached to the first bracket end and when the hair styling iron is attached to the second bracket end, the vacuum is activated and provides a certain suction such that vapors and fumes are suctioned away from the head of the hair styling iron.

2. The apparatus of claim 1, wherein the second bracket end is removably attached to the hair styling iron with an adhesive, pivoting clip, a clasp or a strap.

3. The apparatus of claim 1, wherein the vacuum nozzle housing has at least one filter.

4. The apparatus of claim 1, wherein there is an activation switch for remotely operating the vacuum.

5. The apparatus of claim 1, wherein the hose end is removably connected to a nozzle tube and said nozzle tube is removably connected to the vacuum hose.

6. The apparatus of claim 1, wherein the second bracket end has at least one opening.

* * * * *